US005618036A

United States Patent [19]

Edwards et al.

[11] Patent Number: 5,618,036

[45] Date of Patent: Apr. 8, 1997

[54] PRINTER WITH DISTRIBUTION STATIONS HAVING U-SHAPED SHEET GUIDE

[75] Inventors: Earl G. Edwards, Longmont, Colo.; Armando V. Flores, Lexington, Ky.; John W. Gassett, Lexington, Ky.; James P. Harden, Lexington, Ky.; Daniel L. Huber, Lexington, Ky.; Michael C. Leemhuis, Nicholasville, Ky.; Stephen T. Olson, Lexington, Ky.; Bernard L. Wilzbach, Lexington, Ky.

[73] Assignee: Lexmark International, Inc., Lexington, Ky.

[21] Appl. No.: 559,219

[22] Filed: Nov. 16, 1995

[51] Int. Cl.[6] ..... B65H 5/00; B65H 29/00

[52] U.S. Cl. ..... 271/225; 271/186; 271/188; 271/299

[58] Field of Search ..... 271/184–186, 271/225, 289, 290, 299, 300, 302, 188

[56] References Cited

U.S. PATENT DOCUMENTS

| | | | |
|---|---|---|---|
| 3,104,101 | 9/1963 | Rainbow et al. | 271/69 |
| 3,160,413 | 12/1964 | Faeber | 271/86 |
| 3,434,710 | 3/1969 | Yarger et al. | 271/188 |
| 3,558,109 | 1/1971 | Sofue | 271/188 X |
| 3,606,312 | 9/1971 | Mens et al. | 271/188 X |
| 3,622,150 | 11/1971 | Hayes | 271/68 |
| 3,848,867 | 11/1974 | Johnson | 271/290 |
| 3,907,274 | 9/1975 | D'Amato et al. | 271/64 |
| 3,994,487 | 11/1976 | Wicklund | 271/80 |
| 4,114,871 | 9/1978 | Botte | 271/290 |
| 4,494,748 | 1/1985 | Miyashita et al. | 271/288 |
| 4,729,555 | 3/1988 | Brocklehurst | 271/175 |
| 4,805,892 | 2/1989 | Calhoun | 271/225 |
| 5,086,320 | 2/1992 | Kolke | 271/290 X |
| 5,358,231 | 10/1994 | Andela | 271/188 X |

FOREIGN PATENT DOCUMENTS

| | | | |
|---|---|---|---|
| 41359 | 2/1992 | Japan | 271/225 |

*Primary Examiner*—Boris Milef
*Attorney, Agent, or Firm*—John A. Brady

[57] ABSTRACT

A printer (1) and portable stations (2 and 3) when located side-by-side form a guide (1*a*, 2*a*, and 3*a*) for paper sheets sent out by printer 1. The paper is moved upward into U-shaped guide 1*a* by pinch rollers (6 and 7) and then moved laterally by pinch rollers (8 and 9) in guide 1*a*. Similar rollers are in guides 2*a* and 3*a* to direct the paper to the selected station and then downward.

9 Claims, 4 Drawing Sheets

PRINTER WITH DISTRIBUTION STATIONS HAVING U-SHAPED SHEET GUIDE

TECHNICAL FIELD

This invention relates to printers having the capability of delivering printed output sheets to a variety of stations, specifically, to large stacks and to small individual trays.

BACKGROUND OF THE INVENTION

Typically, the output sheets from a printer are delivered out of a single portal, which might lead to individual trays for collation or a single, larger area to accumulate a stack of the sheets. The ability to deliver sheets to a variety of output stations which can be separated is not provided.

This invention achieves a combination of a printer, at least two delivery stations which can be separated, and paper transporting mechanism to deliver the paper to any of the stations selected.

The paper being transported is bowed around the inside of a duct. U.S. Pat. No. 4,729,555 to Brocklehurst discloses the movement of sheets after severing. The sheets are moved laterally along a roller to one of several stacking stations where the sheets are loaded into stacks on a support surface. U.S. Pat. No. 3,994,487 to Wicklund discloses a lateral sheet offsetting mechanism which moves a series of upwardly bowed sheets to a slight offset position before they are moved downward into a stack. U.S. Pat. Nos. 3,160,413 to Faeber and 3,622,150 to Hayes disclose initial bowing and then,flat stacking. U.S. Pat. Nos. 3,907,274 to D'Amato et al and 4,494,748 to Miyashita et al disclose sheet conveying systems in which the sheets are separately conveyed over a series of stacking stations and then separately delivered to one of the several stacks.

DISCLOSURE OF THE INVENTION

The printing system of this invention initially conveys printed sheets upward to a duct in which the sheets are bowed. The duct extends laterally to at least two output stations. One of the stations might be a large receptacle for vertical stacking while the other might be a series of small trays stacked vertically. Powered pinch rollers in the duct directed along the duct drive the paper through the duct to a position over a selected one of the stations. Powered pinch rollers in the duct directed downward then drive the paper downward into the receiving station. The inside of the duct has serrated edges which prevent the paper from sticking to the side of the duct.

BRIEF DESCRIPTION OF THE DRAWING

The details of this invention will be described in connection with the accompanying drawing, in which.

BEST MODE FOR CARRYING OUT THE INVENTION

Figure 1:
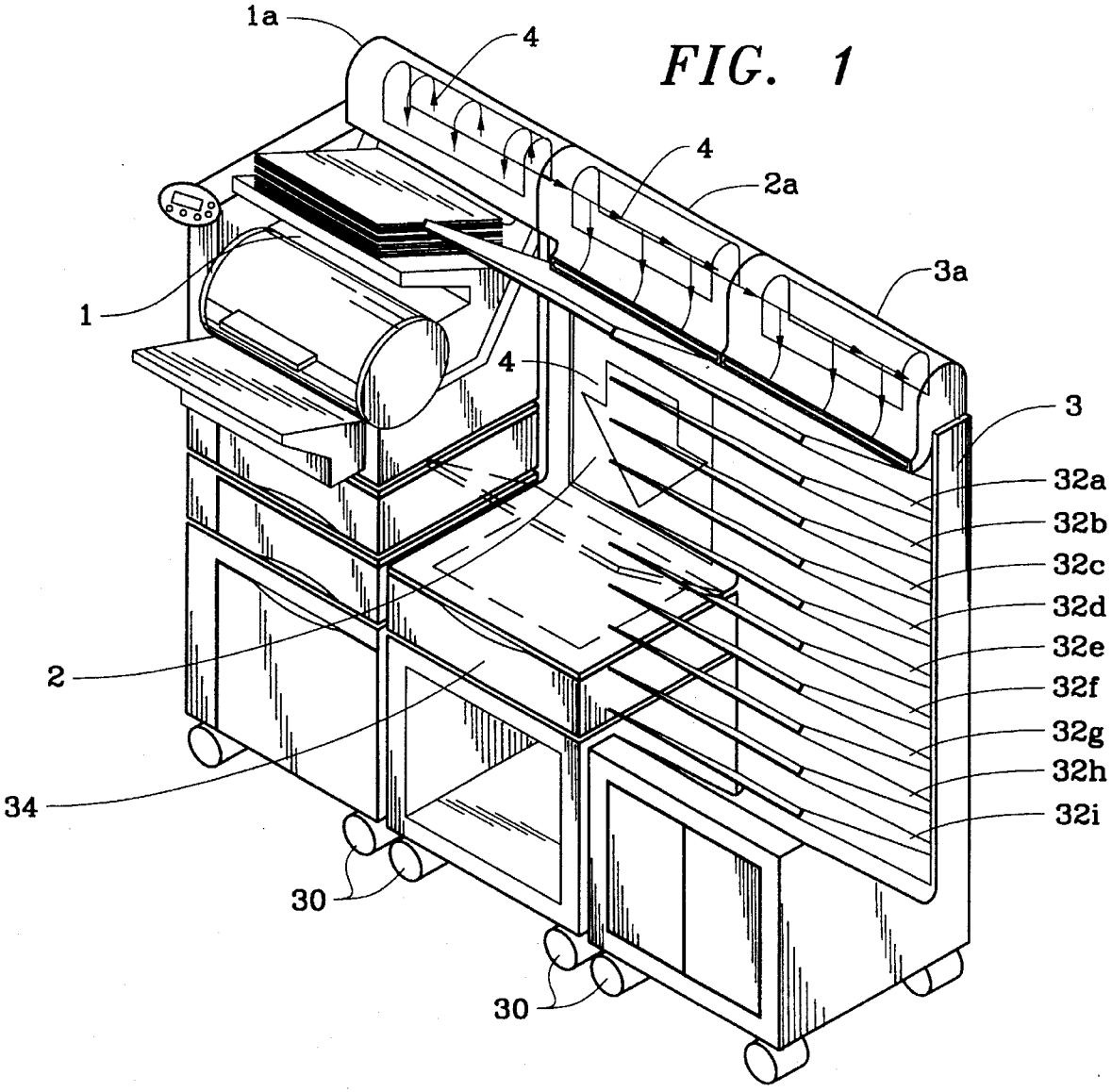
FIG. 1 illustrates the printing system as a whole.
Figure 2:
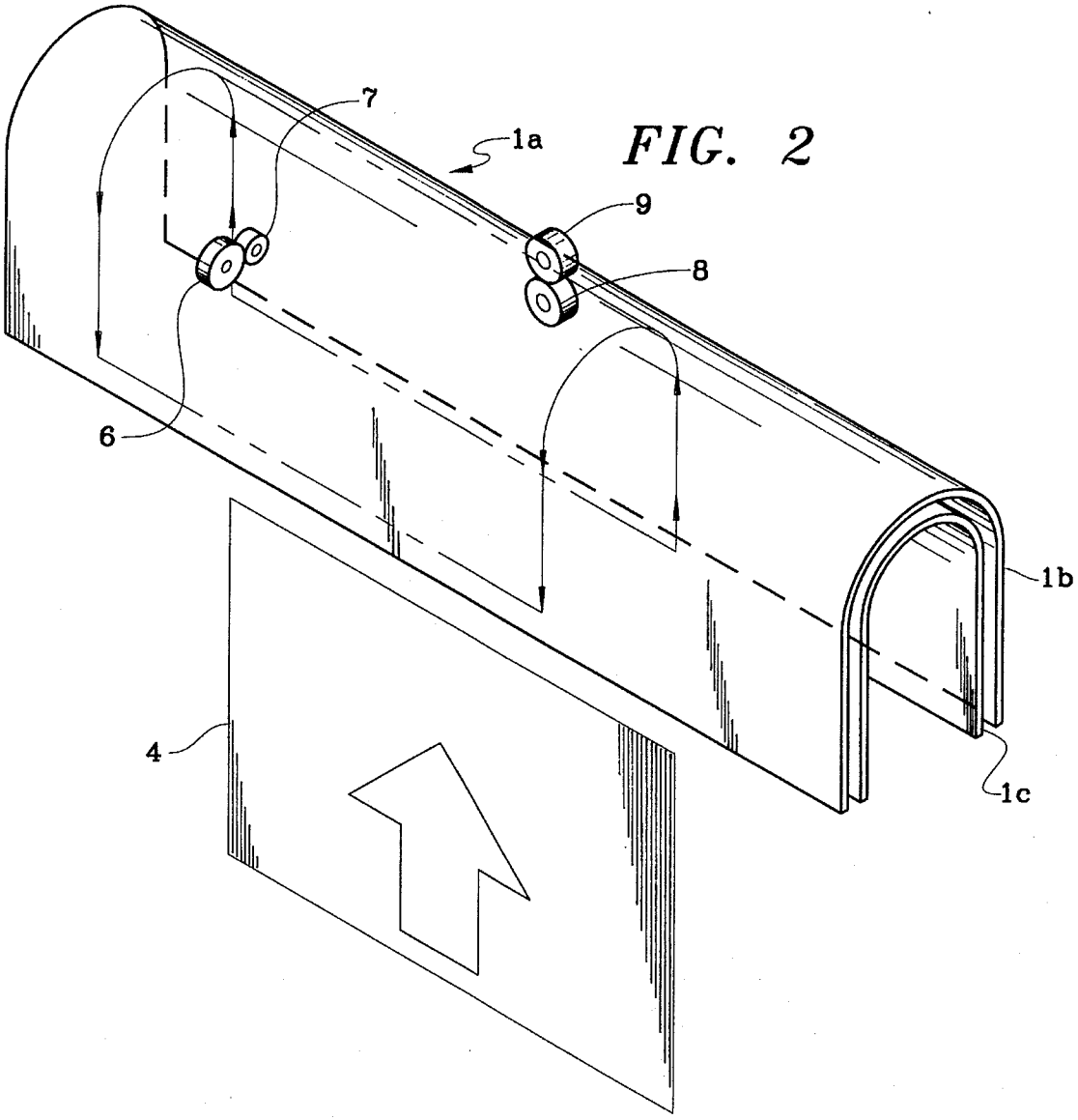
FIG. 2 is a perspective view illustrating the guide duct which receives paper from the printer.

FIG. 1 shows the printer 1 combined with a stacking receiving station 2 and a "mail box" receiving station 3. Output stations 2 and 3 are optional and may be installed independently or together to enlarge the overall function. To accomplish this additional function, the device transports the printed media sheets 4 such as ordinary paper or transparency sheets (FIG. 2 and arrows in FIG. 1) from the printer 1 to the stations 2 and 3. Arrows 4 in the drawing represent the sheet 4 and point toward the direction of movement of sheet 4.

Sheet 4 exits printer 1 vertically to be; transported to the optional devices 2 and 3. Upon reaching the U-shaped duct 1*a* above printer 1, paper 4 is moved laterally in accordance with this invention.

Figure 3:
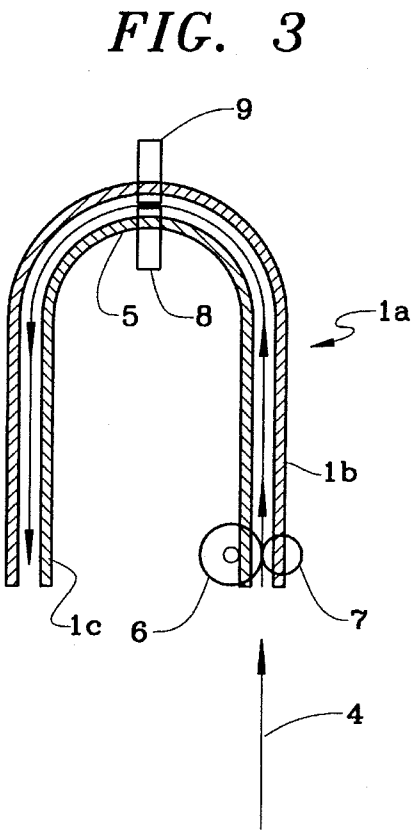
FIG. 3 is a side view illustrating the guide duct of FIG. 2.

Sheet 4 enters U-shaped paper guide duct 1*a* and stops bowed into a U-shape. As shown by arrows in FIGS. 2 and 3, guide 1*a* has outer surface 1*b* and inner surface 1*c* spaced apart sufficient to easily receive sheet 4 between those surfaces. Sheet 4 is driven into position and stopped by drive roller 6 and backup roller 7 on the back side of guide 1*a*. Backup roller 7 is then disengaged to release sheet 4 from being held vertically.

Figure 5:
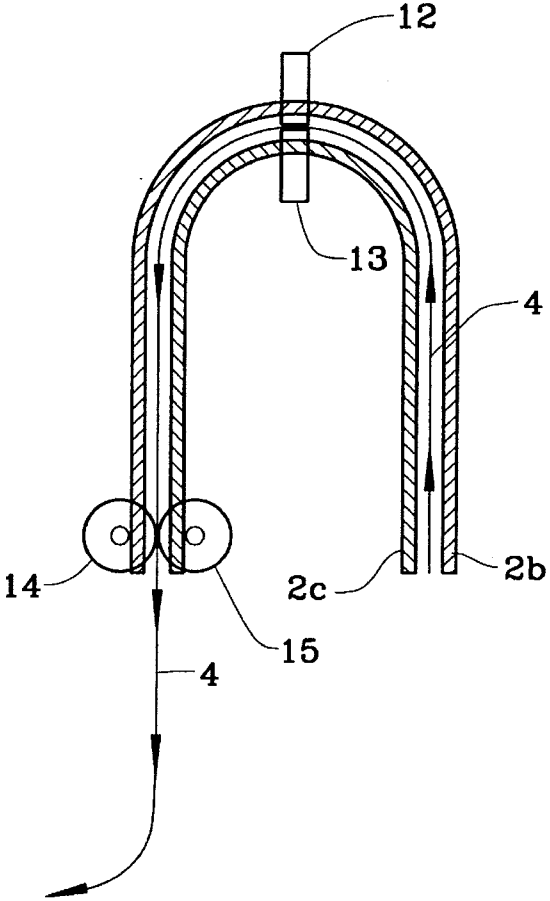
FIG. 5, is a side view from tile right of FIG. 4 illustrating the duct of FIG. 4.
Figure 4:
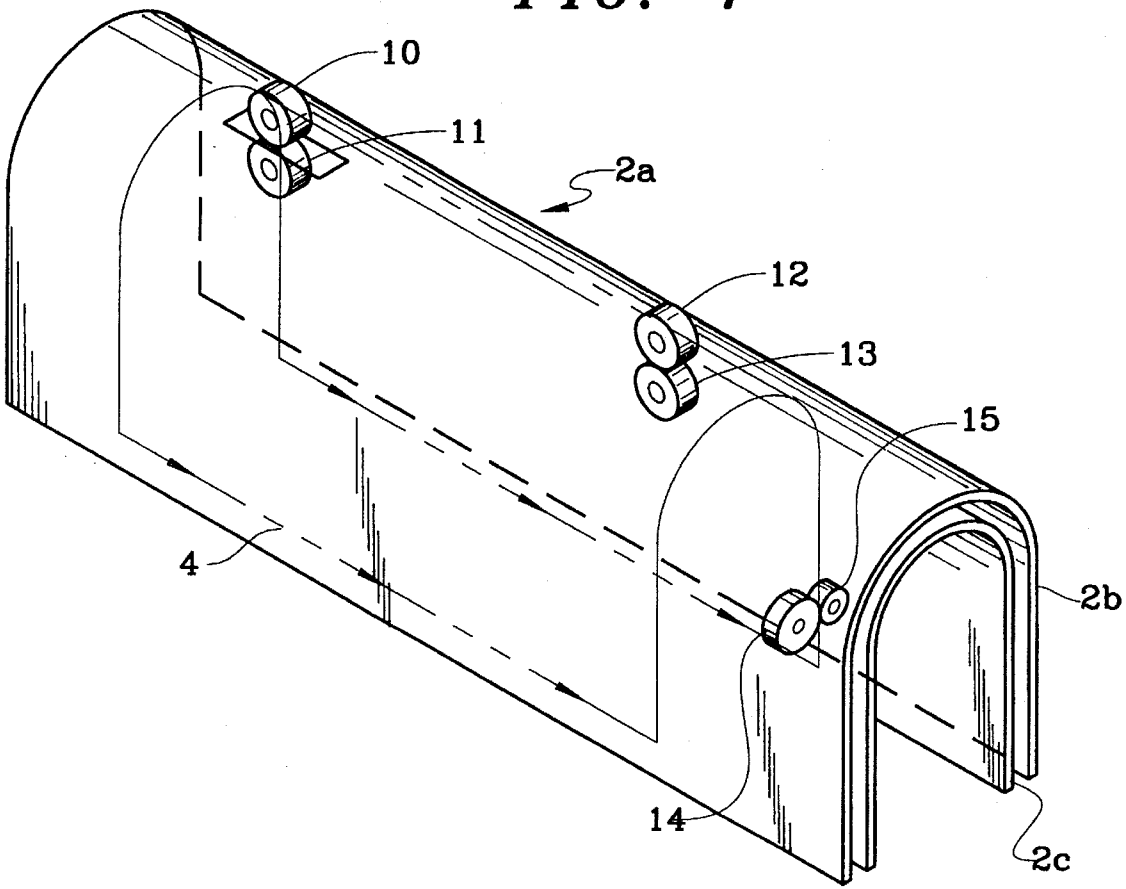
FIG. 4 is a perspective view illustrating the guide duct above a receiving station.

Horizontal drive roller 8 and backup roller 9 are then engaged to drive sheet 4 horizontally into horizontal transporter guide 2*a* (FIG. 4 and FIG. 5). The arrows 4 show sheet transportation which is left to right since the FIG. 4 view is from the same side as the FIG. 1 view. Guide 2*a* has outer surface 2*b* and spaced inner surface 2*c* which form the same guide configuration as guide 1*a*. Horizontal drive rollers 11 and 13 and backup rollers 10 and 12 are engaged to drive the sheet 4 to the right as shown. Vertical drive roller 14 and backup roller 15 are disengaged to allow the horizontal transport of media 4 through guide 2*a*. If station 2 is selected, drive rollers 11 and 13 are disengaged to stop media 4 and then drive roller 14 and backup roller 15 are engaged to feed sheet 4 through guide 2*a* downward to be stacked in station 2.

If the media is to be output at station 3, drive roller 13 continues to drive, while vertical rollers 14 and 15 are separated. Sheets 4 is then fed into guide 3*a*. Guide 3*a* is functionally and structurally the same as guide 2*a* for purposes of this invention and therefore is not illustrated separately in detail. Sheets 4 to be delivered to the individual trays of station 3 are driven downward.

Overall control of the assembly is by microprocessor, as is now conventional, and therefore is not described in detail. Similarly, deflection of the downwardly moving sheets 4 into the trays of station 3 may be entirely conventional and therefore is not described in detail.

Figure 6:
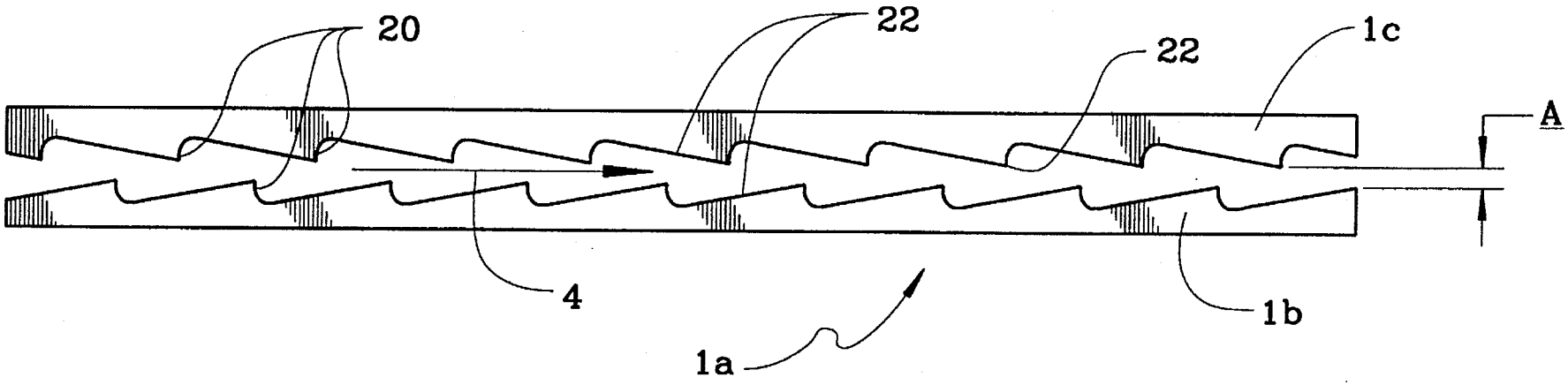
FIG. 6 is illustrative of the serrations in the guide ducts.
Figure 7:
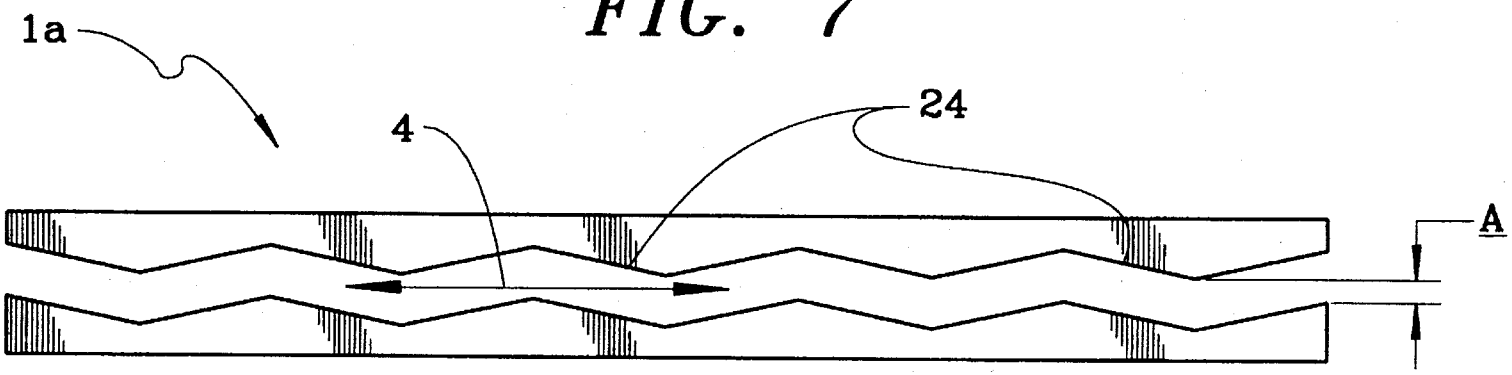
FIG. 7 is illustrative of alternate serrations in the guide ducts.

To feed media in a vertical and horizontal direction a unique rib pattern or serrations is utilized within the guides 1*a*, 2*a*, and 3*a*. This configuration is shown in FIG. 6. Ribs 20 extend inwardly in the guides, such as guide 1*a* in FIG. 6. Ribs 20 have points which contact sheet 4 to allow sheet 4 to travel in the vertical (upward and downward in FIG. 6) direction by reducing friction and static build-up of electricity on sheet 4. The angular ramps 22 of ribs 20 are directed along the direction of lateral travel to allow sheet 4 to feed in a horizontal direction (rightward in FIG. 6). The contact of sheet 4 with the points of ribs 20 also reduces friction in the horizontal direction. Additionally, an offsetting location of ribs 20 on opposite side of guide 1*a* allow for a tight 2 mm gap A in the guides 1*a*, 2*a*, and 3*a* without closing the paper path due to tolerance build-up. FIG. 7 shows a triangular, symmetrical alternate ribs 24 also spaced apart 2 mm, which allow media to flow horizontally in left or right directions and is otherwise comparable in function to the rib pattern of FIG. 6.

At least stations 2 and 3 are portable; being shown on wheels 30 in FIG. 1. When they are moved to be located side-by-side, guides 1*a*, 2*a*, and 3*a* are the same configuration where they meet and therefore form a continuous duct between printer 1 and stations 2 and 3.

The stack of trays 32*a* through 32*i* of station 3 may be individual slots for users or may be trays for collating individual documents, as is conventional. Box receptacle 34 of station 2 is deep enough to receive a large stack of sheets 4.

Alternative designs will be apparent and can be anticipated to be developed. Patent protection is sought as provided by law, with particular reference to the accompanying claims.

What is claimed is:

1. An assembly comprising a printer, a station comprising a large receptacle for receiving sheets from said printer, a station comprising at least two trays for receiving sheets from said printer, and a sheet guide having a U-shaped outer surface and a U-shaped inner surface which bends said sheets between said outer surface and said inner surface about an axis parallel to the direction of movement of the sheets; into a U-shape for transfer within said guide in said U-shape, said guide being located above said printer and said stations and connecting said printer and said stations for receiving printed sheets transported in a vertical direction from said printer to bend said sheets and thereafter laterally direct said bent sheets along said guide to a selected one of said stations.

2. The assembly as in claim 1 in which at least said stations are portable and in which portions of said guide are integral with each of said stations.

3. The assembly as in claim 1 in which said U-shaped outer surface has inner serrations and said U-shaped inner surface has inner serrations.

4. The assembly as in claim 3 in which said serrations are pointed in the vertical direction and slanted in the direction of sheet travel in the lateral direction.

5. The assembly as in claim 4 in which at least said stations are portable and in which portions of said guide are integral with each of said stations.

6. The assembly as in claim 3 in which at least said stations are portable and in which portions of said guide are integral with each of said stations.

7. An assembly for printing comprising a guide for sheets comprising a U-shaped outer surface and a U-shaped inner surface spaced from said outer surface to form a sheet conveying path therebetween; at least three selectable first pinch rollers directed to move sheets vertically between said outer surface and said inner surface to bring said sheets to a U-shape, and at least three selectable second pinch rollers directed to move sheets in a direction perpendicular to the direction of movement imparted on the sheets by said first pinch rollers along said guide, at least one of said first pinch rollers and at least one of said second pinch rollers being located over a printer and positioned to receive sheets from said printer, at least one of said first pinch rollers and at least one of said second pinch rollers being located over a first sheet receiving station to receive sheets transported along said guide and move sheets into said first station with said at least one first pinch roller located over said first sheet receiving station and move sheets in said perpendicular direction with said at least one second pinch roller located over said first sheet receiving station, and at least one of said first pinch rollers and at least one of said second pinch rollers being located over a second sheet receiving station to receive sheets transported along said guide and move sheets into said second station with said at least one first pinch roller located over said second sheet receiving station and move sheets in said perpendicular direction with said at least one second pinch roller located over said second sheet receiving station.

8. The assembly as in claim 7 in which the inside of said guide has serrations.

9. The assembly as in claim 8 in which said serrations are pointed in said vertical direction and slanted in said perpendicular direction of sheet travel.

* * * * *